United States Patent [19]

deVries et al.

[11] 4,285,822

[45] * Aug. 25, 1981

[54] PROCESS FOR PREPARING A SULFURIZED MOLYBDENUM-CONTAINING COMPOSITION AND LUBRICATING OIL CONTAINING THE COMPOSITION

[75] Inventors: Louis deVries, Greenbrae; John M. King, San Rafael, both of Calif.

[73] Assignee: Chevron Research Company, San Francisco, Calif.

[ * ] Notice: The portion of the term of this patent subsequent to May 5, 1998, has been disclaimed.

[21] Appl. No.: 52,697

[22] Filed: Jun. 28, 1979

[51] Int. Cl.[3] ..... C10M 1/32; C10M 1/38; C10M 1/44; C10M 1/54

[52] U.S. Cl. ..... 252/46.4; 252/25; 252/33.6; 252/34.7; 252/49.7; 252/51; 252/389 R; 252/389 A; 252/400 R; 252/400 A

[58] Field of Search ..... 252/33.6, 46.4, 389 A, 252/389 R, 400 A, 400 R, 34.7, 49.7, 51, 25; 260/429 R, 429 K

[56] References Cited

U.S. PATENT DOCUMENTS

| | | | |
|---|---|---|---|
| 3,244,627 | 4/1966 | Smith et al. | 252/33.6 |
| 3,509,051 | 4/1970 | Farmer et al. | 252/33.6 |
| 4,098,705 | 7/1978 | Sakurai et al. | 252/33.6 |
| 4,164,473 | 8/1979 | Coupland et al. | 252/32.7 E |
| 4,178,258 | 12/1979 | Papay et al. | 252/33.6 |

FOREIGN PATENT DOCUMENTS 1095973 12/1960 Fed. Rep. of Germany .

*Primary Examiner*—W. J. Shine
*Attorney, Agent, or Firm*—D. A. Newell; V. J. Cavalieri

[57] ABSTRACT

Antioxidant additives for lubricating oil are prepared by (1) combining a polar solvent, an acidic molybdenum compound and an oil-soluble basic nitrogen compound to form molybdenum-containing complex and (2) contacting said complex with carbon disulfide to form a sulfur-and molybdenum-containing composition.

16 Claims, No Drawings

PROCESS FOR PREPARING A SULFURIZED MOLYBDENUM-CONTAINING COMPOSITION AND LUBRICATING OIL CONTAINING THE COMPOSITION

FIELD OF THE INVENTION

This invention relates to new lubricating oil compositions. More specifically, it relates to new lubricating oil compositions containing antioxidant molybdenum compounds.

BACKGROUND OF THE INVENTION

Molybdenum disulfide has long been known as a desirable additive for use in lubricating oil compositions. However, one of its major detriments is its lack of oil solubility. Molybdenum disulfide is ordinarily finely ground and then dispersed in the lubricating oil composition to impart friction modifying and antiwear properties. Finely ground molybdenum disulfide is not an effective oxidation inhibitor in lubricating oils.

As an alternative to finely grinding the molybdenum disulfide, a number of different approaches involving preparing salts of molybdenum compounds have been tried. One type of compound which has been prepared is molybdenum dithiocarbamates. Representative compositions are described in U.S. Pat. No. 3,419,589, which teaches molybdenum (VI) dioxide dialkyldithiocarbamates; U.S. Pat. No. 3,509,051, which teaches sulfurized oxymolybdenum dithiocarbamates; and U.S. Pat. No. 4,098,705, which teaches sulfur containing molybdenum dihydrocarbyl dithiocarbamate compositions.

An alternative approach is to form dithiophosphates instead of dithiocarbamates. Representative of this type of molybdenum compound are the compositions described in U.S. Pat. No. 3,494,866, such as oxymolybdenum diisopropylphosphorodithioate.

U.S. Pat. No. 3,184,410 describes certain dithiomolybdenyl acetylacetonates for use in lubricating oils.

Braithwaite and Greene in *Wear*, 46 (1978) 405–432 describe various molybdenum-containing compositions for use in motor oils.

U.S. Pat. No. 3,349,108 teaches a molybdenum trioxide complex with diethylenetriamine for use as an additive for molten steel.

Russian Pat. No. 533,625 teaches lube oil additives prepared from ammonium molybdate and alkenylated polyamines.

Another way to incorporate molybdenum compounds in oil is to prepare a colloidal complex of molybdenum disulfide or oxysulfides dispersed using known dispersants. U.S. Pat. No. 3,223,625 describes a procedure in which an acidic aqueous solution of certain molybdenum compounds is prepared and then extracted with a hydrocarbon ether dispersed with an oil soluble dispersant and then freed of the ether. U.S. Pat. No. 3,281,355 teaches the preparation of a dispersion of molybdenum disulfide by preparing a mixture of lubricating oil, dispersant, and a molybdenum compound in water or $C_{1-4}$ aliphatic alcohol, contacting this with a sulfide ion generator and then removing the solvent. Dispersants noted to be effective in this procedure are petroleum sulfonates, phenates, alkylphenate sulfides, phosphosulfurized olefins and combinations thereof.

SUMMARY OF THE INVENTION

It has now been found that a lubricating oil additive can be prepared using a polar promotor, an acidic molybdenum compound, an oil-soluble basic nitrogen containing composition, and carbon disulfide.

DETAILED DESCRIPTION OF THE INVENTION

Lubricating oil compositions containing the additive disclosed herein are effective as either fluid and grease compositions (depending upon the specific additive or additives employed) for inhibiting oxidation, imparting antiwear and extreme pressure properties, and modifying the friction properties of the oil which may, when used as a crankcase lubricant, lead to improved mileage. The precise molecular formula of the molybdenum compositions of this invention is not known with certainty; however, they are believed to be compounds in which molybdenum, whose valences are satisfied with atoms of oxygen or sulfur is either complexed by or the salt of one or more nitrogen atoms of the basic nitrogen containing composition used in the preparation of these additives. It is possible, however, that dithiocarbamate groups are formed.

The molybdenum compounds used to prepare the additives for compositions of this invention are acidic molybdenum compounds. By acidic is meant that the molybdenum compounds will react with a basic nitrogen compound as measured by ASTM test D-664 or D-2896 titration procedure. Typically these molybdenum compounds are hexavalent and are represented by the following compositions: molybdic acid, ammonium molybdate, sodium molybdate, potassium molybdate and other alkaline metal molybdates and other molybdenum salts such as hydrogen salts, e.g. hydrogen sodium molybdate $MoOCl_4$, $MoO_2Br_2$, $Mo_2O_3Cl_6$, molybdenum trioxide or similar acidic molybdenum compounds. Preferred acidic molybdenum compounds are molybdic acid, ammonium molybdate, and alkali metal molybdates. Particularly preferred are molybdic acid and ammonium molybdate.

The polar promoter used in the process of this invention is one which facilitates the interaction between the acidic molybdenum compound and the basic nitrogen compound. A wide variety of such promoters can be used. Typical promoters are 1,3-propanediol, 1,4-butanediol, diethylene glycol, butyl cellosolve, propylene glycol, 1,4-butyleneglycol, methyl carbitol, ethanolamine, diethanolamine, N-methyl-diethanolamine, dimethyl formamide, N-methyl acetamide, dimethyl acetamide, methanol, ethylene glycol, dimethyl sulfoxide, hexamethyl phosphoramide, tetrahydrofuran and water. Preferred are water and ethylene glycol. Particularly preferred is water.

While ordinarily the polar promoter is separately added to the reaction mixture, it may also be present, particularly in the case of water, as a component of non-anhydrous starting materials or as waters of hydration in the acidic molybdenum compound, such as $(NH_4)_6Mo_7O_{24}.4\ H_2O$. Water may also be added as ammonium hydroxide.

The basic nitrogen compound must have a basic nitrogen content as measured by ASTM D-664 or D-2896. It is preferably oil-soluble. Typical of such compositions are succinimides, carboxylic acid amides, hydrocarbyl monoamines, hydrocarbon polyamines, Mannich bases, phosphonamides, thiophosphoramides, dispersant viscosity index improvers, and mixtures thereof. These basic nitrogen-containing compounds are described below (keeping in mind the reservation that each must have at least one basic nitrogen). Any of the nitrogen-containing compositions may be after-treated with e.g., boron, using procedures well-known in the art so long as the after-treated compound continues to contain basic nitrogen. These after-treatments are particularly applicable to succinimides and Mannich base compositions.

The mono and polysuccinimides that can be used to prepare the lubricating oil additives described herein are disclosed in numerous references and are well known in the art. Certain fundamental types of succinimides and the related materials encompassed by the term of art "succinimide" are taught in U.S. Pat. Nos. 3,219,666, 3,172,892, and 3,272,746, the disclosures of which are hereby incorporated by reference. The term succinimide is understood in the art to include many of the amide, imide, and amidine species which are also formed by this reaction. The predominant product, however, is a succinimide and this term has been generally accepted as meaning the product of a reaction of an alkenyl substituted succinic acid or anhydride with a nitrogen containing compound. Preferred succinimides, because of their commercial availability, are those succinimides prepared from a hydrocarbyl succinic anhydride, wherein the hydrocarbyl group contains from about 24 to about 350 carbon atoms, and an ethylene amine, said ethylene amines being especially characterized by ethylene diamine, diethylene triamine, triethylene tetraamine, and tetraethylene pentamine. Particularly preferred are those succinimides prepared from polyisobutenyl succinic anhydride of 70 to 128 carbon atoms and tetraethylene pentaamine or triethylene tetraamine or mixtures thereof.

Also included within the term succinimide are the cooligomers of a hydrocarbyl succinic acid or anhydride and a poly secondary amine containing at least one tertiary amino nitrogen in addition to two or more secondary amino groups. Ordinarily this composition has between 1,500 and 50,000 average molecular weight. A typical compound would be that prepared by reacting polyisobutenyl succinic anhydride and ethylene dipiperazine. Compositions of this type are disclosed in U.S. Ser. No. 816,063, filed July 15, 1977 the disclosure of which is hereby incorporated by reference.

Carboxylic amide compositions are also suitable starting materials preparing the products of this invention. Typical of such compounds are those disclosed in U.S. Pat. No. 3,405,064, the disclosure of which is hereby incorporated by reference. These compositions are ordinarily prepared by reacting (a) a carboxylic acid or anhydride ester thereof, having at least 12 to about 350 aliphatic carbon atoms in the principal aliphatic chain and, if desired, having sufficient pendant aliphatic groups to render the molecule oil soluble which is with (b) an amine or a hydrocarbyl polyamine, such as an ethylene amine, to give a mono or polycarboxylic acid amide. Preferred are those amides prepared from (1) a carboxylic acid of the formula $R^2COOH$, where $R^2$ is $C_{12-20}$ alkyl or a mixture of this acid with a polyisobutenyl carboxylic acid in which the polyisobutenyl group contains from 72 to 128 carbon atoms and (2) an ethylene amine, especially triethylene tetraamine or tetraethylene pentaamine or mixtures thereof.

Another class of compounds which are useful in this invention are hydrocarbyl monoamines and hydrocarbyl polyamines preferably of the type disclosed in U.S. Pat. No. 3,574,576, the disclosure of which is hereby incorporated by reference. The hydrocarbyl, which is preferably alkyl, or olefinic having one or two sites of unsaturation, usually contains from 9 to 350, preferably from 20 to 200 carbon atoms. Particularly preferred hydrocarbyl polyamines are those which are derived, e.g., by reacting polyisobutenyl chloride and a polyalkylene polyamine, such as an ethylene amine, e.g. ethylene diamine, diethylene triamine, tetraethylene pentaamine, 2-aminoethylpiperazine, 1,3-propylene diamine, 1,2-propylenediamine and the like.

Another class of compounds useful for supplying basic nitrogen are the Mannich base compositions. These oil soluble compositions are prepared from a phenol or $C_{9-200}$ alkylphenol, an aldehyde, such as formaldehyde or formaldehyde precursor such as paraformaldehyde, and an amine compound. The amine may be a mono or polyamine and typical compositions are prepared from an alkylamine such as methylamine or an ethylene amine, such as, diethylene triamine, treithylene tetraamine or tetraethylene pentaamine and the like. The phenolic material may be sulfurized and preferably is dodecylphenol or a $C_{80-100}$ alkylphenol. Typical Mannich bases which can be used in this invention are disclosed in U.S. Pat. No. 4,157,309, and U.S. Pat. Nos. 3,649,229, 3,368,972 and 3,539,663, the disclosures of which are hereby incorporated by reference. The last application discloses Mannich bases prepared by reacting an alkylphenol having at least 50 carbon atoms, preferably 50 to 200 carbon atoms with formaldehyde and an alkylene polyamine $HN(ANH)_nH$ where A is a saturated divalent alkyl hydrocarbon of 2 to 6 carbon atoms and n is 1–10 and where the condensation product of said alkylene polyamine may be further reacted with urea or thiourea. The utility of these Mannich bases as starting materials for preparing lubricating oil additives can often be significantly improved by treating the Mannich base using conventional techniques to introduce boron into the composition.

Another class of composition useful for preparing the additives of this invention are the phosphoramides and phosphonamides such as those disclosed in U.S. Pat. Nos. 3,909,430 and 3,968,157 the disclosures of which are hereby incorporated by reference. These compositions may be prepared by forming an oil soluble phosphorus compound having at least one P—N bond. They can be prepared, for example, by reacting phosphorus oxychloride with a hydrocarbyl diol in the presence of a monoamine or by reacting phosphorus oxychloride with a difunctional secondary amine and a mono-functional amine. Thiophosphoramides can be prepared by reacting an unsaturated hydrocarbon compound containing from 2 to 450 or more carbon atoms, such as polyethylene, polyisobutylene, polypropylene, ethylene, 1-hexene, 1,3-hexadiene, isobutylene, 4-methyl-1-pentene, and the like, with phosphorus pentasulfide and nitrogen-containing compound as defined above, particularly an alkylamine, alkyldiamine, alkylpolyamine, or an alkyleneamine, such as ethylene diamine, diethylenetriamine, triethylenetetraamine, tetraethylenepentaamine, and the like.

Another class of nitrogen-containing compositions useful in preparing the molybdenum compositions of this invention includes the so-called dispersant viscosity index improvers (VI improvers). These VI improvers are commonly prepared by functionalizing a hydrocarbon polymer, especially a polymer derived from ethylene and/or propylene, optionally containing additional units derived from one or more co-monomers such as alicyclic or aliphatic olefins or diolefins. The functionalization may be carried out by a variety of processes which introduce a reactive site or sites which usually has at least one oxygen atom on the polymer. The polymer then contacted with a nitrogen-containing source to introduce nitrogen-containing functional groups on the polymer backbone. Commonly used nitrogen sources include any basic nitrogen compound especially those nitrogen-compounds and compositions described herein. Preferred nitrogen sources are alkylene amines, such as ethylene amines, alkyl amines, and Mannich bases.

Preferred basic nitrogen compounds for use in this invention are succinimides, carboxylic acid amides, and Mannich bases.

The process of this invention may be carried out as illustrated below.

A solution of the acidic molybdenum compound, polar promoter and a basic nitrogen containing compound is prepared with or without diluent. A diluent which does not react with the molybdenum containing compound and the sulfur generating compound is desirable. Typical diluents are lubricating oil or a liquid compound containing only carbon and hydrogen. The diluent provides a minimum dilution of the reaction mixture to enable the mixture to be efficiently stirred. If the mixture of initial components is sufficiently fluid to be stirred, no diluent is necessary. If desired, ammonium hydroxide may also be added to the reaction mixture to provide a solution of ammonium molybdate. This reaction is carried out at a temperature from the melting point of the mixture to reflux temperature. It is ordinarily carried out at atmospheric pressure although higher or lower pressures may be used if desired. The reaction mixture is then treated with carbon disulfide. In some cases, removal of water from the reaction mixture may be desirable prior to completion of reaction with the carbon disulfide.

In the reaction mixture, the ratio of molybdenum compound to basic nitrogen compound is not critical; however, as the amount of molybdenum with respect to basic nitrogen increases, the filtration of the product becomes more difficult. Since the molybdenum component probably oligomerizes, it is advantageous to add as much molybdenum as can easily be maintained in the composition. Usually, the reaction mixture will have charged to it from 0.01 to 2.00 atoms of molybdenum per basic nitrogen atom. Preferably from 0.4 to 1.0, and most preferably from 0.4 to 0.7, atoms of molybdenum per atom of basic nitrogen is added to the reaction mixture.

Carbon disulfide is usually charged to the reaction mixture in such a ratio to provide 0.1 to 4.0 atoms of sulfur per atom of molybdenum. Preferably from 0.5 to 3.0 atoms of sulfur per atom of molybdenum is added, and most preferably, 1.0 to 2.6 atoms of sulfur per atom of molybdenum.

The polar promoter, which is preferably water, is ordinarily present in the ratio of 0.1 to 50 mols of water per mol of molybdenum. Preferably from 5.0 to 25 and most preferably 1.0 to 15 mols of the promoter is present per mol of molybdenum.

The lubricating oil compositions containing the additives of this invention can be prepared by admixing, by conventional techniques, the appropriate amount of the molybdenum-containing composition with a lubricating oil. The selection of the particular base oil depends on the contemplated application of the lubricant and the presence of other additives. Generally, the amount of the molybdenum-containing additive will vary from 0.05 to 15% by weight and preferably from 0.2 to 10% by weight.

The lubricating oil which may be used in this invention includes a wide variety of hydrocarbon oils, such as naphthenic bases, paraffin bases and mixed base oils as well as synthetic oils such as esters and the like. The lubricating oils may be used individually or in combination and generally have a viscosity which ranges from 50 to 5,000 SUS and usually from 100 to 15,000 SUS at 38° C.

In many instances it may be advantageous to form concentrates of the molybdenum containing additive within a carrier liquid. These concentrates provide a convenient method of handling and transporting the additives before their subsequent dilution and use. The concentration of the molybdenumcontaining additive within the concentrate may vary from 0.25 to 90% by weight although it is preferred to maintain a concentration between 1 and 50% by weight. An embodiment of this invention includes a concentrate containing from 15% to 90% by weight of the molybdenum-containing additive. The final application of the lubricating oil compositions of this invention may be in marine cylinder lubricants as in crosshead diesel engines, crankcase lubricants as in automobiles and railroads, lubricants for heavy machinery such as steel mills and the like, or as greases for bearings and the like. Whether the lubricant is fluid or a solid will ordinarily depend on whether a thickening agent is present. Typical thickening agents include polyurea acetates, lithium stearate and the like.

If desired, other additives may be included in the lubricating oil compositions of this invention. These additives include antioxidants or oxidation inhibitors, dispersants, rust inhibitors, anticorrosion agents and so forth. Also anti-foam agents stabilizers, anti-stain agents, tackiness agents, anti-chatter agents, dropping point improvers, anti-squawk agents, extreme pressure agents, odor control agents and the like may be included.

Certain molybdenum products that can be prepared by the process of invention also find utility in making brake lining materials, in high-temperature structural materials, in iron and steel alloys, in cladding materials, in electroplating solutions, as components for electrical discharge machine electrodes, as fuel additives, in making self-lubricating or wear-resistant structures, as mold release agents, in compositions for phosphatizing steel, in brazing fluxes, in nutrient media for microorganisms, in maing electrosensitive recording material, in catalysts for refining coal, oil, shale, tar sands, and the like or as stabilizers or curing agents for natural rubber or polymers.

The following examples are presented to illustrate the operation of the invention and are not intended to be a limitation upon the scope of the claims.

EXAMPLE 1

To a 500 ml flask was added 290 grams (0.1 mols active) of a solution of 45% concentrate in oil of the succinimide prepared from polyisobutenyl succinic anhydride and tetraethylene pentaamine and having a number average molecular weight for the polyisobutenyl group of about 980. This mixture was heated to 140° C. and to it was added dropwise a solution containing 28.8 grams (0.2 mols) of molybdenum trioxide dissolved in approximately 100 ml of concentrated ammonium hydroxide. The addition took place over a period of two hours and was accompanied by heavy foaming. The reaction mixture was then heated to 170° C. to remove the water, and a small amount of xylene was added to remove the remaining amount of water from the solution. The reaction was filtered through diatomaceous earth and approximately 8.34 grams of molybdenum trioxide was removed on the filter pad. The product was then dissolved in 300 ml of xylene and heated to 70° C. Slowly, 60 ml carbon disulfide was added, the heat was increased to 105° C. (reflux) and held for four hours. Hydrogen sulfide gas evolved. Heating was continued at 115° C. for two hours until no more hydrogen sulfide gas evolved. The reaction mixture was filtered through diatomaceous earth to yield a product containing 1.36% sulfur, 4.61% molybdenum, 2.88% oxygen and 1.82% nitrogen.

EXAMPLE 2

To a 1 liter flask containing 290 grams of the succinimide described in Example 1 and heated to 140° C. was added dropwise under nitrogen 28.8 grams (0.2 mols) of molybdenum trioxide dissolved in 100 ml of concentrated ammonium hydroxide. The foaming of the product was very heavy and it took two hours to add about ⅓ of the molybdenum trioxide solution. Five drops of foam inhibitor was added and the remainder of the molybdenum solution was added over a period of one hour. To this mixture was added, 400 ml toluene and then the solvent was stripped at 120° to 125° C. To this mixture was added 500 ml hexanes and the solution was filtered through diatomaceous earth. The hexanes were removed, 200 ml toluene was added and then at 70° C., 60 grams of carbon disulfide was added. The reaction mixture was heated to 105° C. and maintained at this temperature for five hours. Heating was continued for two hours at 120° C. and carbon disulfide was removed with distillation. This mixture was treated with hydrogen sulfide at room temperature for three hours using a hydrogen sulfide sparge to give a light positive pressure. Toluene was removed at 140° C. to yield a composition containing 4.51% molybdenum, 1.75% oxygen, 1.73% nitrogen and 3.75% sulfur.

EXAMPLE 3

To a 1 liter flask was added 290 grams of the succinimide described in Example 1 and heated to 110° C. Molybdenum trioxide, 28.8 grams (0.2 mols) was dissolved in 0.21 mols ammonia from concentrated ammonium hydroxide (12.9 grams) diluted to 100 ml with water. This mixture was heated for 10 minutes at 66° C. under nitrogen and then added dropwise over a period of one hour to the succinimide under nitrogen atmosphere. After most of the water had been removed from this mixture by stripping, 200 ml of toluene was added and the temperature was raised to from 120° to 130° C. Toluene was replaced with 200 ml of xylene and the temperature increased to 145° to 150° C. over a period of four hours. To this reaction mixture was added 0.24 mols (18.3 grams) of carbon disulfide. The mixture was refluxed at 105° C. over a period of four hours. Then, approximately 1 liter of hexanes were added and the mixture was filtered through diatomaceous earth leaving a small amount of sediment which was not water soluble and appeared to be molybdenum trioxide. The product contained 6.04% molybdenum, 3.76% oxygen, 1.16% sulfur, 1.89% nitrogen and 0.08% sediment.

EXAMPLE 4

Lubricating oil compositions containing the additives prepared according to this invention have been tested in a variety of tests. Reported below are results from certain of these tests which are described as follows.

In the Oxidator B test the stability of the oil is measured by the time required for the consumption of 1 liter of oxygen by 100 grams of the test oil at 340° F. In the actual test, 25 grams of oil is used and the results are corrected to 100-gram samples. The catalyst which is used at a rate of 1.38 cc per 100 cc oil contains a mixture of soluble salts providing 95 ppm copper, 80 ppm iron, 4.8 ppm manganese, 1100 ppm lead, and 49 ppm tin. The results of this test are reported as hours to consumption of 1 liter of oxygen and our measure of the oxidative stability of the oil.

The anti-corrosion properties of compositions can be tested by their performance in the CRC L-38 bearing corrosion test. In this test, separate strips of copper and lead are immersed in the test lubricant and the lubricant is heated for 20 hours at a temperature of 295° F. The copper strip is weighed and then washed with potassium cyanide solution to remove copper compound deposits. It is then re-weighed. The weight losses of the two strips are reported as a measure of the degree of corrosion caused by the oil.

The copper strip test is a measure of corrosivity toward non-ferrous metals and is described as ASTM Test Method D-130. Anti-wear properties are measured by the 4-ball wear and the 4-ball weld tests. The 4-ball wear test is described in ASTM D-2266 and the 4-ball weld test is ASTM D-2783.

The coefficient of friction of lubricating oils containing additives of this invention was tested in the Kinetic Oiliness Testing Machine (KOTM) manufactured by G. M. Neely of Berkeley, Calif. The procedure used in this test is described by G. L. Neely, Proceeding of Midyear Meeting, American Petroleum Institute 1932, pp. 60–74 and in ASLE Transactions, Vol. 8, pages 1–11 (1965 and ASLE Transactions, Vol. 7, pages 24–31 (1964). The coefficient of friction was measured under boundary conditions at 150° and 204° C. using a 1 Kg load and a molybdenum-filled ring on a cast-iron disk. The data for some of the tests run on compositions of this invention is reported in the Table below. The particular formulations tested are given in the footnotes.

TABLE

| Product 1 of Example | Oxidator B, hrs. | ASTM D-2266, mm | ASTM D-2783 Kg | L-38 Cu, mg | L-38 Pb, mg | D-130 | Coefficient of Friction 150° C. | Coefficient of Friction 204 |
|---|---|---|---|---|---|---|---|---|
| 1 | 13.4 | .41 | 170 | 51.3 | 4.7 | C | 0.089 | 0.036 |
| 2 | 9.75 | .34 | 187 | 18.3 | 3.3 | C | 0.052 | 0.026 |

TABLE-continued

| Product 1 of Example | Oxidator B, hrs. | ASTM D-2266, mm | ASTM D-2783 Kg | L-38 Cu, mg | L-38 Pb, mg | D-130 | Coefficient of Friction 150° C. | Coefficient of Friction 204 |
|---|---|---|---|---|---|---|---|---|
| 3 | 12.1 | .40 | 140 | 18.1 | 2.9 | C | 0.116 | 0.026 |

1 Neutral oil formulation containing 3.5% of a 50% concentrate of succinimide, 20 mmols/kg sulfurized calcium phenate, 30 mmols/kg overbased magnesium sulfonate 5.5% viscosity index improver, and 22 mmols/kg product of this invention. (If necessary, additional succinimide was added to bring the total nitrogen content of the finished oil to 2.14%.)

What is claimed is:

1. A process for preparing a sulfurized molybdenum-containing composition which comprises (1) reacting an acidic molybdenum compound and a basic nitrogen compound selected from the group consisting of a succinimide, carboxylic acid amide, hydrocarbyl monoamine, hydrocarbyl polyamine, Mannich base, phosphonamide, thiophosphonamide, phosphoramide, dispersant viscosity index improver, or mixtures thereof, in the presence of a polar promoter, to form a molybdenum complex wherein from 0.01 to 2.00 atoms of molybdenum are present per basic nitrogen atom, and the promoter is present in the ratio of 0.01 to 50 mols of water per mol of molybdenum; and (2) reacting said complex with carbon disulfide, in an amount to provide 0.1 to 4.0 atoms of sulfur per atom of molybdenum, to form a sulfur- and molybdenum-containing composition.

2. The process of claim 1 wherein the acidic molybdenum compound is molybdic acid, ammonium molybdate, or an alkali metal molybdate.

3. The process of claim 2 wherein said acidic molybdenum compound is molybdic acid or ammonium molybdate, and said basic nitrogen compound is a succinimide, carboxylic acid amide, or a Mannich base prepared from a $C_{9-200}$ alkylphenol, formaldehyde, and an amine.

4. The process of claim 3 wherein said oil-soluble basic nitrogen compound is a polyisobutenyl succinimide prepared from polyisobutenyl succinic anhydride and tetraethylene pentaamine or triethylenetetraamine or mixtures thereof.

5. The process of claim 3 wherein said basic nitrogen compound is a carboxylic acid amide prepared from one or more carboxylic acids of the formula $R^2$—COOH, wherein $R^2$ is $C_{12-350}$ alkyl or $C_{12-350}$ alkenyl and a hydrocarbyl polyamine.

6. The process of claim 5 wherein $R^2$ is $C_{12-20}$ alkyl or $C_{12-20}$ alkenyl and the hydrocarbyl polyamine is tetraethylene pentaamine or triethylene tetraamine.

7. The process of claim 3 wherein said basic nitrogen compound is an alkenyl polyamine prepared from polyisobutenyl chloride and ethylene diamine, diethylene triamine, triethylene tetraamine, or tetraethylene pentaamine, or mixtures thereof.

8. The process of claim 3 wherein said basic nitrogen compound is the Mannich base prepared from dodecyl phenol, formaldehyde, and methylamine.

9. The process of claim 3 wherein said Mannich base is prepared from a $C_{80-100}$ alkyl phenol, formaldehyde, and triethylene tetraamine, or tetraethylene pentaamine, or mixtures thereof.

10. The process of claims 1, 2, 3, 4, 5, 6, 7, 8, or 9 wherein said polar promoter is water.

11. The product prepared by the process of claim 1, 2, 3, 4, 5, 6, 7, 8, or 9.

12. The product prepared by the process of claim 10.

13. A lubricating oil composition comprising an oil of lubricating viscosity and from 0.05 to 15% by weight of the product of claim 11.

14. A lubricating oil concentrate composition comprising an oil of lubricating viscosity and from 15 to 90% by weight of the product of claim 11.

15. A lubricating oil composition comprising an oil of lubricating viscosity and from 0.05 to 15% by weight of the product of claim 12.

16. A lubricating oil concentrate composition comprising an oil of lubricating viscosity and from 15 to 90% by weight of the product of claim 12.

* * * * *

UNITED STATES PATENT AND TRADEMARK OFFICE

CERTIFICATE OF CORRECTION

PATENT NO. : 4,285,822

DATED : August 25, 1981

INVENTOR(S) : Louis deVries et al

It is certified that error appears in the above-identified patent and that said Letters Patent are hereby corrected as shown below:

Column 5, line 64, "from 5.0" should read --from 0.5--

Column 6, line 55, "maing" should read --making--

Signed and Sealed this

*Twenty-second* Day of *December 1981*

[SEAL]

*Attest:*

GERALD J. MOSSINGHOFF

*Attesting Officer*

*Commissioner of Patents and Trademarks*